United States Patent [19]

Brownbill

[11] 4,249,362

[45] Feb. 10, 1981

[54] CAPPING MACHINERY

[75] Inventor: Thomas D. Brownbill, West Bromwich, England

[73] Assignee: Metal Closures Group Limited, London, England

[21] Appl. No.: 960,666

[22] Filed: Nov. 14, 1978

[30] Foreign Application Priority Data

Mar. 22, 1978 [GB] United Kingdom ..... 11402/78

[51] Int. Cl.[3] ..... B67B 3/20; B65B 7/28

[52] U.S. Cl. ..... 53/490; 53/331.5

[58] Field of Search ..... 53/485, 487, 488, 490, 53/308, 317, 329, 331.5, 332

[56] References Cited

U.S. PATENT DOCUMENTS

| | | | |
|---|---|---|---|
| 2,559,358 | 7/1951 | Hullhorst et al. | 53/331.5 |
| 2,660,355 | 11/1953 | Allen | 53/485 |
| 3,913,301 | 10/1975 | Keller et al. | 53/331.5 |

FOREIGN PATENT DOCUMENTS

| | | | |
|---|---|---|---|
| 2621499 | 12/1977 | Fed. Rep. of Germany | 53/331.5 |

*Primary Examiner*—Horace M. Culver

*Attorney, Agent, or Firm*—Stevens, Davis, Miller & Mosher

[57] ABSTRACT

A method for applying a threaded closure to a container, said closure having sealing means in or towards the crown thereof, which method comprises applying the closure to the container by the application of a predetermined rotary torque thereto, continuing the application of the closure to the container until the desired torque applied is obtained and thereafter applying axial pressure to the closure crown towards and on to the container while simultaneously applying said torque whereby the closure pressure serves to disengage the threads to overcome at least some of the friction therebetween to permit a greater proportion of the applied torque to be applied to the sealing means within the closure.

36 Claims, 3 Drawing Figures

CAPPING MACHINERY

The present invention relates to capping machinery and has particular reference to a method and apparatus for applying threaded closures to bottles and containers.

Hitherto the mechanical capping of bottles has occurred in one of two ways. In the traditional manner a plain unthreaded metal blank incorporating a sealing wad or liner has been applied to a bottle and the thread has been subsequently rolled into the metal surface of the blank to match the particular bottle to which it is applied. In this way, each cap individually fits the inconsistencies in the finish of the bottle to which it is applied.

The disadvantage of this arrangement is, however, that the sealing of such caps when used with pressurized contents is suspect; and it is necessary to include a sealing liner in the crown of each closure blank prior to formation of the thread and insertion of the liner into the cap involves a separate operation.

In order to overcome this, it has been proposed to form a one-piece sealing closure formed of a plastics material.

Our co-pending Patent Applications Nos. 25389/75, 50545/77 and 9341/78 describe and claim one-piece plastic sealing closures each of which is capable of overcoming the problem of the insertion of a separate liner into the metal blank.

It is, however, necessary to apply the closures to the container.

The closures forming the subject of the applications numbered as above are all, in a preferred embodiment provided with a substantially cylindrical skirt having screw threads formed on the inner surface adapted to cooperate with corresponding threads on the external surface of the bottle or container neck.

Existing capping machinery seeks to apply the closure by rotating the closure about its axis on application to the container to engage the threads and continuing the rotation until a predetermined torque is applied. With a plastics closure having an integral sealing arrangement, it is essential that the torque be concentrated on the seal itself and not in overcoming the friction between the threads on the internal surface of the closure skirt and the threads on the external surface of the container neck.

A capping machine for a closure generally comprises a capping head for retention of the closure and means for rotating the head assembly about the closure axis, the head assembly being caused to move up and down in response to interengagement between the thread of the closure with the thread on the neck of the container. It is usual for such a capping machine to have a plurality of capping heads disposed about the periphery of a turret and as the assembly moves progressively about the axis of the turret, each capping head is caused to move up and down by engagement of a central carriage for the capping head, with a cam disposed about the periphery of the turret.

According to one aspect of the present invention, there is provided apparatus for applying a threaded closure to a container, which apparatus comprises means for supporting a closure for application to the container, means for rotating the closure support means about the closure axis, clutch means to permit slip between the closure support means and the rotation means when a predetermined torque has been applied to the closure on the container, and closure pressure means adapted to engage said closure and to apply axial pressure thereto towards the container to which it is being applied while simultaneously applying said torque whereby said closure pressure means serves to disengage the threads to overcome at least some friction therebetween so that a greater proportion of said applied torque is applied to the sealing means within the closure.

The apparatus in accordance with the present invention may form part of a turret capping machine as described above.

The means for supporting the closure may be a spring-loaded collet in which the closure is a push fit. The collet may be carried in a capping head mounted for rotation on a rotatable shaft. The capping head may be driven by the shaft to rotate about the closure axis. The clutch means is preferably disposed between the shaft and the capping head.

The rotatable shaft for the capping head may be keyed for rotation with a ram cylinder for imparting drive from the ram cylinder to the shaft per se. An upper end of the shaft is preferably disposed within the ram cylinder and may carry a piston and associated sealing rings therein. The shaft and piston may be slidable axially with respect to the cylinder. A portion of the shaft intermediate the capping head and the cylinder may be threaded and adapted to carry adjusting nuts. An upper adjusting nut may secure a compression spring between the cylinder and said adjusting nut so that relative movement between the shaft and the cylinder, against the spring bias moves the piston from its datum in the cylinder. This arrangement allows lost motion between the capping head and the turret cam follower to permit interengagement of the threads between the closure and the container with respect to said shaft and may be driven via said clutch means. In a preferred embodiment of the present invention, the shaft is provided at its lower end with a radial flange the upper surface of which carries an annulus of friction material constituting the clutch means. The capping head is preferably cup-shaped in form, the open mouth being disposed generally downwards. The upper part is adapted to receive the shaft for rotation between the head and the shaft. The upper portion of the capping head may include a thrust race. The threaded portion of the shaft may carry a lower adjusting nut; a compression spring may be disposed between said lower adjusting nut and the thrust race for the purpose of applying a downward bias on the capping head against the annulus of friction material between the two thereby allowing adjustment of the transmitted torque between the shaft and the capping head. The collet may be carried in the cavity defined by the capping head.

The shaft may be provided with a central air passageway and the capping head may be provided with a plurality of circumferentially spaced auxiliary cylinders.

The lower periphery of the capping head may include a plurality of radially disposed punches which are disposed about a skirt extension of the closure constituting a security ring for the closure. On the application of air under pressure through the central passage of the shaft, the auxiliary cylinders are actuated to drive the punches radially inwardly to effect a punching operation on the skirt extension.

It will be appreciated that the closure applied by the apparatus of the present invention can be either a plastics mould enclosure having a moulded sealing means provided on the internal surface thereof, or in the alternative may be a metal closure having a sealing wad or the like carried in the upper portion thereof juxtaposed the crown. It will be appreciated where a security ring is employed a cylindrical skirt extension may constitute the sealing ring and locking tabs may be punched out in the same operation as the application of the closure to the container.

The present invention also includes a capping machine incorporating a head assembly in accordance with the present invention.

In another aspect of the present invention, there is provided a method for applying a threaded closure to a container, said closure having sealing means in or towards the crown thereof, which method comprises applying the closure to the container by the application of a predetermined rotary torque thereto, continuing the application of the closure to the container until the desired torque applied is obtained and thereafter applying axial pressure to the closure crown towards and on to the container while simultaneously applying said torque whereby the closure pressure serves to disengage the threads to overcome at least some of the friction therebetween to permit a greater proportion of the applied torque to be applied to the sealing means within the closure.

The invention also includes a container carrying a closure applied in accordance with the invention.

Following is a description by way of example only and with reference to the accompanying informal drawings of apparatus in accordance with the present invention.

Figure 1:
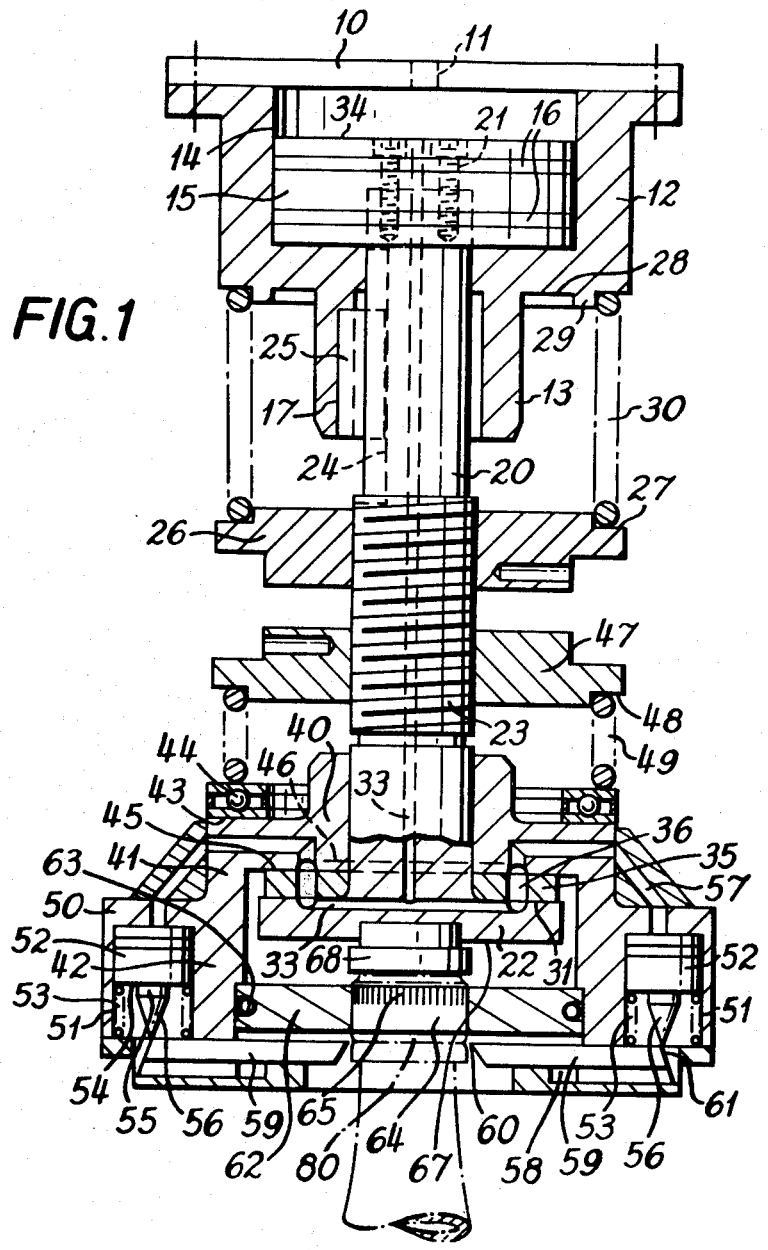
FIG. 1 is a section through a capping assembly in accordance with the present invention.

The apparatus shown in FIG. 1 is intended to be used in connection with a turret-type capping machine whereby the assembly and the bottle move in register about the periphery of a turret. As the assembly moves about the turret, the head is lowered towards the bottle to engage the skirt of a closure over the neck thereof and continued rotation results in continued lowering of the head and simultaneous rotation thereof until the closure has been applied and on completion of the cycle the head is withdrawn to leave the closure on the neck of the bottle to which it has been applied. The capping apparatus, on returning to a datum position receives a new cap ready to repeat the cycle of operations. Such capping machines are generally known per se in the art and have been used for many years for the purpose of applying metal caps and ordinary plastics caps to threaded containers.

A drive plate 10 is connected with the capping machine described above and provides the basic up-and-down and rotational movement to be applied to the head assembly. The drive plate 10 has a bore 11 for the supply of air under pressure. The drive plate 10 carries a cylinder 12 having a downwardly extending sleeve 13. The cylinder 12 has an inner bore 14 and accommodates for sliding movement therein a piston 15 having rings 16 to effect a seal between the periphery of the piston 15 and the surface of cylindrical bore 14. Piston 15 is secured to the downwardly extending longitudinal shaft 20 and is secured thereto by means of bolts 21, shaft 20 being slidable within downwardly extending sleeve 13. The shaft terminates at its lower end in a radially directed flange 22, has an intermediate threaded portion 23, and has towards its upper end, an axially disposed groove or keyway 24. The surface of downwardly extending sleeve 13 adjacent keyway 24 is also provided with a keyway 17 and is adapted to receive a key 25 so that shaft 20 is keyed to sleeve 13 and thence to cylinder 12 and drive plate 10 for rotation therewith. It should be noted that the keyway 24 is of greater longitudinal extent than key 17 to permit axial sliding movement of the shaft 20 with respect to sleeve 13 and its associated cylinder 12.

The intermediate threaded portion 23 carries towards the upper end thereof first adjusting nut 26 which is threaded on its internal surface for engagement with the threads on the shaft 20 and is provided on the upper surface with a peripheral rebate 27.

The lower surface 28 is provided with an annular rib 29 which serves to define a locating rib for a compression spring 30 an upper end of which is located by annular rib 29 and the lower end of which is seated in rabbet 27 of adjusting nut 26.

The flange 22 has in its upper surface an annular groove 32 which communicates with a central air way 33 extending axially of shaft 20 from the upper surface 34 of piston 15.

The upper surface 31 of flange 22 carries an annulus of friction material 35 having a plurality of circumferentially spaced holes 36 each of which communicates with annular groove 32.

The lower portion of the shaft carries for relative rotation thereon a hub 40 having a generally radially extending portion 41 and a downwardly extending cylindrical portion indicated generally at 42 to define a hollow cavity accommodating inter alia flange 22 at the lower end of shaft 20.

The upper face 43 of radially extending portion 41 carries a thrust race 44 the upper member of which is adapted for rotation relative to hub 40.

The lower annular face 45 and radial extension 41 have an annular groove constituting a manifold 46 and adapted to cooperate with the holes 36 in the friction material while the lower annular face 45 constitutes the opposite friction face whereby the flange 22, annulus 35, and the lower face 45, between them constitute a torque limiting drive whereby rotation of shaft 20 and associated flange 22 is transmitted to hub 40.

The threaded portion 23 carries a second adjusting nut 47 having a peripheral rabbet 48 accommodating the upper portion of a spring 49 the lower portion of which engages with thrust race 44.

By adjustment of nut 47, the bias of spring 49 can be applied to the annulus 35 of friction material in order to control the torque transmitted between the flange 22 and the hub 40.

The cylindrical portion 42 has a radially expanded portion 50 which accommodates a plurality, in this case six, auxiliary cylinders 51 each cylinder 51 accommodates a piston 52 and is biased to an upper position in the cylinder 51 by means of a spring 53. The lower end 54 of piston 52 has a downward extension 55 which terminates in a conical portion 56. The upper portion of cylinder 51 communicates with an air passage 57 which communicates with manifold 46 the arrangement being such that air supplied under pressure via central bore 11 in drive plate 10 enters above the piston 15, enters the upper end of central airway 33, passes to the annular passage 32 and via the holes 36 in the friction material 35 to manifold 46 and thence to each of a plurality of cylinders 51 to drive each piston 52 downwardly against the bias of spring 53.

The hub of cylindrical portion 42 is provided towards the lower extremity with a radial guide 58 associated with each servo cylinder 51. Each guide accommodates a punch 59 having a punching edge 60 juxtaposed a skirt extension of a closure located in the head. The outer extremity of each punch 59 is provided with an inclined frustoconical surface 61 which corresponds and mates with the conical portion carried by piston 52 the arrangement being such that downward movement of the piston is transmitted to radial inward movement of the punch to effect a punching operation on a closure juxtaposed thereto. The punch 59 is biased to its radial outer position by means of a spring or springs (not shown).

The cavity defined by cylindrical portion 42 accommodates a collet 62 having an annular spring 63 said collet being fixedly secured within the cylindrical inner surface of portion 42 for rotation therewith. The collet 62 has a generally cylindrical closure reception portion 64, the internal surface of which is provided with a plurality of axially disposed serrations 65 over at least part of its surface to cooperate with serrations or knurl on the closure applied thereto. The arrangement is such that a closure of the kind described in our copending application No. 9341/78 can be inserted either manually or automatically into collet 62 to expand the collet against the spring 63 thereby positively retaining the closure into position therein and for rotation therewith.

The underside 67 of flange 22 carries a pressure plate 68 adapted to engage the crown of the closure, said plate 68 being rotatably mounted with respect to flange 22.

Figure 2:
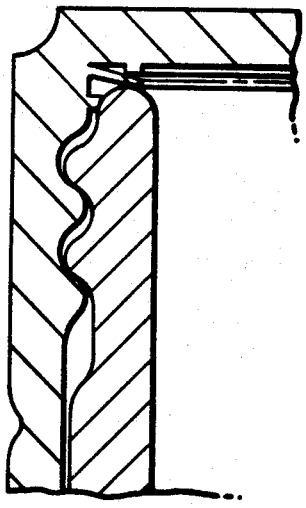
FIG. 2 is a part section through a closure showing the situation that exists when the predetermined applied torque limit is obtained.

In operation, the head is disposed in the turret with the drive plate in the uppermost position. A closure 80 is inserted in collet 62 and at the same time a bottle is located in a support tray below the head and clamped thereto. The bottle and head are thus in register and movement of the head assembly around the turret results in the application of downward drive by means of the cam described above to drive plate 10. At the same time drive plate 10 is rotated and rotational movement is transmitted via cylinder 12 and sleeve 13 through key 17 to shaft 20. The rotation of shaft 20 is transmitted via flange 22, friction annulus 35 to hub 40 and thus to collet 62 fixedly attached for rotation therewith. The closure is located in the collet with the knurl on the closure aligning with the serrations 65 on the internal surface of the collet, and the closure is thus also rotated. As the drive plate moves progressively down, the closure is lowered until the extended skirt thereof enters over the neck of the container. Continued lowering of drive plate 10 results in continued lowering of the closure on to the neck of the container until the lowermost lead-in of the thread on the closure is abutting the upper thread on the container. The plate 10 continues to move down steadily, but, unless the lead of the threads match immediately, there will be a delay in the ability of the closure to move downwardly on the neck of the container until the thread leads engage. As a result, the collet 62 plate 68 and the hub 40 to which they are secured are precluded from further downward movement. This prevention of further downward movement is transmitted to shaft 20 which allows the cylinder 12 to move downwardly with respect thereto, thus lifting piston 15 from its seat. When the threads engage, the downward movement of the hub 40 is controlled by the engagement between the threads on the closure and the container neck, thus possibly resulting in further lost vertical motion between the shaft 20 and the cylinder 12 which is taken up by means of spring 30. As the drive plate 10 moves progressively downward and approaches the end of travel, spring 30 will be partially compressed and the closure will be fully threaded on the neck of the container. Once the limiting torque application is reached, the torque limiting device described above comes into operation by allowing slip between flange 22, annulus 35 and the lower annular face 45 of radially extending portion 41 of hub 40. At the same time air pressure is then applied via inlet 11 to the upper part of cylinder 12. The air pressure exerts pressure on the piston 15 and serves to drive the piston downwards thereby driving the shaft 20 downwards with respect to cylinder 12 and to lower flange 22 with respect to hub 40 sufficient to drive pressure plate 68 and the abutting closure downwardly with respect to the container. At the time that the drive to hub 40 via annulus 35 has stalled, the position of the threads of the closure relative to the threads of the bottle is as shown in FIG. 2 of the accompanying drawings.

Figure 3:
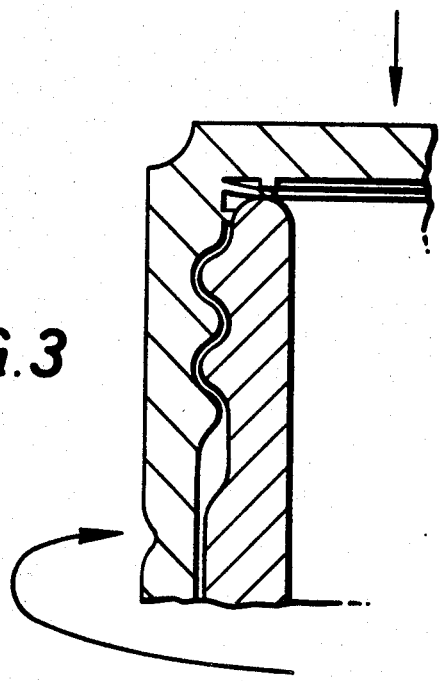
FIG. 3 shows the closure of FIG. 2 with the centering of the threads on the application of the axial pressure described above.

The lowering of piston 12 and flange 22 brings pressure plate 68 to apply pressure downwardly to a head of the closure and serves to drive closure downwardly on to the container thus freeing and disengaging the threads as shown in FIG. 3.

The spring 49 reacts to drive the hub 40 and its associated assembly downward to re-engage the drive between flange 22 and the hub 40 to permit further torque application to the closure. At the same time, the continued application of air pressure to the space above piston 15 results in pressure being applied via airway 33 to groove 32 via holes 36 to manifold 46, and from thence to each of auxiliary pistons 52. Each piston is driven downwardly by the applied air pressure as that the conical portion 56 engages frustoconical portion 61 at the radially outer end of punch 59 and serves to drive the punch inwardly so that the punch edge 60 engages with the skirt extension of the closure to punch a tongue inwardly of the skirt extension to engage with a security band previously moulded on the glass finish of the container to which the closure is applied.

Further rotation of the turret results in the commencement of the withdrawal of the drive plate 10 and the air pressure applied via inlet 11 is terminated, the punches 59 returned to their datum disengaged position under the effect of their spring as the piston moves upwardly under the influence of their associates springs 53. Continued upward movement of shaft 20 serves to snap the closure 80 from collet 62 by virtue of the clamping of the bottle beneath the head. On completion of the cycle the bottle is then unclamped and the cycle is repeated once more.

It will be appreciated from the foregoing that the apparatus described above provides a means of overcoming the frictional effect between the threads as illustrated in FIG. 2 and to ensure that the predetermined torque is to a greater extent applied to the sealing ring and not in overcoming friction between the threads on the closure and the threads on the bottle. At the same time the capping head provides means for simultaneously punching a security ring in a skirt extension to the closure.

What we claim is:

1. A method for applying a threaded closure to a container, said closure having sealing means in or towards the crown thereof, which method comprises applying the closure to the container by the application of a predetermined rotary torque thereto, continuing the application of the closure to the container until the desired torque applied is obtained and thereafter applying axial pressure independently to the closure crown towards and on to the container while simultaneously applying said torque whereby the closure pressure serves to disengage the threads to overcome at least some of the friction therebetween to permit a greater proportion of the applied torque to be applied to the sealing means within the closure.

2. Apparatus for applying a threaded closure to a container, which apparatus comprises means for supporting a closure for application to the container, means for rotating the closure support means about the closure axis, clutch means to permit slip between the closure support means and the rotation means when a predetermined torque has been applied to the closure on the container, and closure pressure means adapted to engage said closure and to apply axial pressure independently thereto towards the container to which it is being applied while simultaneously applying said torque whereby said closure pressure means serves to disengage the threads to overcome at least some friction therebetween so that a greater proportion of said applied torque is applied to the sealing means within the closure.

3. Apparatus as claimed in claim 2 wherein the means for supporting the closure is a spring-loaded collet in which the closure is a push fit.

4. Apparatus as claimed in claim 3 when the collet is carried in a capping head mounted for rotation on a rotatable shaft constituting the rotation means.

5. Apparatus as claimed in claim 4 wherein the clutch means is disposed between the shaft and the capping head to permit relative rotation of said shaft with respect to said head.

6. The apparatus of claim 4 or 5 wherein said rotatable shaft is keyed to a ram cylinder which imparts rotation from the ram cylinder to the shaft.

7. Apparatus as claimed in claim 6 wherein an upper end of said rotatable shaft is disposed within said ram cylinder and carries a piston and associated sealing rings therein.

8. Apparatus as claimed in claim 7 wherein the said shaft and said piston are slidable axially with respect to the cylinder.

9. Apparatus as claimed in claim 4 or 5 wherein a portion of the shaft intermediate the capping head and the cylinder is threaded and adapted to carry at least one adjusting nut.

10. Apparatus as claimed in claim 9 wherein an upper adjusting nut serves to secure and adjust a compression spring between the cylinder and said upper adjusting nut whereby relative movement between the shaft and the cylinder against the spring bias moves the piston from its datum in the cylinder.

11. Apparatus as claimed in claims 2, 3, 4 or 5 wherein the clutch means is disposed between the capping head and the lower end of the shaft.

12. Apparatus as claimed in claim 11 wherein the shaft is provided at its lower end with a radial flange the upper surface of which carries an annulus of friction material constituting the clutch means.

13. Apparatus as claimed in claim 12 wherein the capping head is generally cup-shaped in form, the open mouth being disposed generally downwards, and the upper part being adapted to receive the lower end of said shaft.

14. Apparatus as claimed in claim 13 wherein the upper portion of the capping head includes a thrust race.

15. Apparatus as claimed in claim 13 wherein the threaded portion of the shaft carries a lower adjusting nut and wherein a compression spring is disposed between the lower adjusting nut and the thrust race for the purpose of applying a downward bias on the capping head against the annulus of friction material thereby allowing adjustment of the torque capable of being transmitted between the shaft and the capping head via said clutch means.

16. Apparatus as claimed in claims 2, 3, 4 or 5 wherein said rotatable shaft is provided with a central air passageway and the capping head is provided with a plurality of circumferentially spaced auxiliary cylinders.

17. Apparatus as claimed in claim 13 wherein the lower periphery of the capping head includes a plurality of radially disposed punches which are disposed about a skirt extension of the closure constituting a security ring for the closure whereby the supply of air through the central passage of said shaft activates said auxiliary cylinders to drive the punches radially inwardly to effect a punching operation on said skirt extension.

18. Apparatus as claimed in anyone of claim 16 wherein the friction material is provided with a plurality of holes circumferentially disposed about the surface thereof which holes communicate with corresponding grooves in the radial flange and the adjacent surface of the capping head.

19. Apparatus as claimed in claim 7 wherein the said shaft and said piston are slidable axially with respect to the cylinder.

20. Apparatus as claimed in claim 6 wherein a portion of the shaft intermediate the capping head and the cylinder is threaded and adapted to carry at least one adjusting nut.

21. Apparatus as claimed in claim 7 wherein a portion of the shaft intermediate the capping head and the cylinder is threaded and adapted to carry at least one adjusting nut.

22. Apparatus as claimed in claim 8 wherein a portion of the shaft intermediate the capping head and the cylinder is threaded and adapted to carry at least one adjusting nut.

23. Apparatus as claimed in claim 4 wherein the clutch means is disposed between the capping head and the lower end of the shaft.

24. Apparatus as claimed in claim 7 wherein the clutch means is disposed between the capping head and the lower end of the shaft.

25. Apparatus as claimed in claim 8 wherein the clutch means is disposed between the capping head and the lower end of the shaft.

26. Apparatus as claimed in claim 9 wherein the clutch means is disposed between the capping head and the lower end of the shaft.

27. Apparatus as claimed in claim 10 wherein the clutch means is disposed between the capping head and the lower end of the shaft.

28. Apparatus as claimed in claim 4 wherein said rotatable shaft is provided with a central air passageway and the capping head is provided with a plurality of circumferentially spaced auxiliary cylinders.

29. Apparatus as claimed in claim 7 wherein said rotatable shaft is provided with a central air passageway and the capping head is provided with a plurality of circumferentially spaced auxiliary cylinders.

30. Apparatus as claimed in claim 8 wherein said rotatable shaft is provided with a central air passageway and the capping head is provided with a plurality of circumferentially spaced auxiliary cylinders.

31. Apparatus as claimed in claim 14 wherein the lower periphery of the capping head includes a plurality of radially disposed punches which are disposed about a skirt extension of the closure constituting a security ring for the closure whereby the supply of air through the central passage of said shaft activates said auxiliary cylinders to drive the punches radially inwardly to effect a punching operation on said skirt extension.

32. Apparatus as claimed in claim 15 wherein the lower periphery of the capping head includes a plurality of radially disposed punches which are disposed about a skirt extension of the closure constituting a security ring for the closure whereby the supply of air through the central passage of said shaft activates said auxiliary cylinders to drive the punches radially inwardly to effect a punching operation on said skirt extension.

33. Apparatus as claimed in claim 16 wherein the lower periphery of the capping head includes a plurality of radially disposed punches which are disposed about a skirt extension of the closure constituting a security ring for the closure whereby the supply of air through the central passage of said shaft activates said auxiliary cylinders to drive the punches radially inwardly to effect a punching operation on said skirt extension.

34. Apparatus as claimed in claim 17 wherein the friction material is provided with a plurality of holes circumferentially disposed about the surface thereof which holes communicate with corresponding grooves in the radial flange and the adjacent surface of the capping head.

35. Apparatus as claimed in claim 14 wherein the threaded portion of the shaft carries a lower adjusting nut and wherein a compression spring is disposed between the lower adjusting nut and the thrust race for the purpose of applying a downward bias on the capping head against the annulus of friction material thereby allowing adjustment of the torque capable of being transmitted between the shaft and the capping head via said clutch means.

36. Apparatus as claimed in claim 35 wherein the lower periphery of the capping head includes a plurality of radially disposed punches which are disposed about a skirt extension of the closure constituting a security ring for the closure whereby the supply of air through the central passage of said shaft activates said auxiliary cylinders to drive the punches radially inwardly to effect a punching operation on said skirt extension.

* * * * *